United States Patent [19]

Peleschka et al.

[11] 4,123,205

[45] Oct. 31, 1978

[54] ROTARY VANE PUMP WITH SEALING MEANS

[75] Inventors: Gerhard Peleschka, Luetzelhausen; Friederich Nuebling, Biebergemuend, both of Fed. Rep. of Germany

[73] Assignee: Wibau, Gruendau-Rothenbergen, Fed. Rep. of Germany

[21] Appl. No.: 746,734

[22] Filed: Dec. 2, 1976

[30] Foreign Application Priority Data

Jan. 15, 1976 [DE] Fed. Rep. of Germany ..... 2601347

[51] Int. Cl.[2] ..... F01C 19/02; F01C 19/08; F01C 21/00; F01C 1/00

[52] U.S. Cl. ..... 418/127; 418/128; 418/129; 418/137; 418/144; 418/263; 418/178

[58] Field of Search ..... 418/127, 128, 129, 137, 418/140, 144, 260, 261, 263, 264

[56] References Cited

U.S. PATENT DOCUMENTS

| | | | |
|---|---|---|---|
| 2,338,112 | 1/1944 | Hell | 418/264 |
| 2,619,913 | 12/1952 | Longenecker | 418/264 |
| 2,850,215 | 9/1958 | Stokes | 418/264 |
| 3,001,482 | 9/1961 | Osborn | 418/264 |
| 3,294,454 | 12/1966 | Foerster et al. | 418/263 |

FOREIGN PATENT DOCUMENTS

| | | | |
|---|---|---|---|
| 100,360 | 7/1925 | Australia | 418/264 |
| 1,064,917 | 12/1953 | France | 418/263 |
| 313,427 | 12/1933 | Italy | 418/261 |
| 383,883 | 9/1973 | U.S.S.R. | 418/263 |

*Primary Examiner*—John J. Vrablik

*Attorney, Agent, or Firm*—W. G. Fasse; W. W. Roberts

[57] ABSTRACT

A pump is comprised of a housing within which a rotary piston is rotatably mounted, to define therebetween an annular conveying channel between an inlet port and an outlet port. Annular sealing rings between the piston and housing seal the conveying channel at the periphery of the piston. A stopper extends into the conveying channel in the back flow path, and sealing elements are provided to seal the entire cross section of the back flow paths. Radially movable slides on the piston are resiliently urged into the conveying channel, the radial position thereof being controlled by a cam surface in the housing. The slides are urged radially outwardly by springs, and seals are provided on the piston for sealingly guiding the piston in the radial direction.

16 Claims, 6 Drawing Figures

ROTARY VANE PUMP WITH SEALING MEANS

BACKGROUND OF THE INVENTION

The present invention relates to a pump, especially for conveying construction materials, such as concrete mix or the like. Such pumps comprise a rotary piston rotatable in a housing and provided with radial slides which are controllable by means of a cam disk either connected to the housing or forming a unit with the housing, said cam disk controlling the radial slides mechanically or by means of a hydraulic system to adjust the position of the radial slides.

German Patent Publication (DOS) No. 19 11 852 discloses a concrete pump having a rotor or rather a rotary piston as well as rotary slides corresponding to the radial slides mentioned above, whereby these slides are controllable in the radial direction by means of stationary cam disks or curved disks.

It is a disadvantage of the known pump construction that the take-in space is not properly sealed relative to the actual conveying channel. Even where the radial slides or the housing have been subjected to minor wear and tear, the concrete mix begins to desegregate because the liquid component tends to separate from the solids as the liquid component may flow back. Stated differently, the water or the cement slurry tends to flow back into the take-in chamber. Thus, the conveyed concrete mix becomes drier and drier so that it does not correspond any more to a given quality requirement.

In this context, reference should also be made to German Pat. No. 68 09 17 in which the radial slides are pivotally connected to a control lever for controlling the radial slides. The control lever is supported in a double lever manner at one end of a pressure lever which is rotatably secured in the rotary piston. The free end of the control lever is provided with a guide roller which rides in a guide groove, which in turn is provided in a stationary disk. This type of arrangement of the radial slide control is rather complicated and it may be assumed that a safe operation cannot be provided by this type of structure, due to the entry of portions of the slurry into the radial slide control, and further in view of the fact that the apparatus must work under rough operating conditions.

OBJECTS OF THE INVENTION

In view of the above, it is the aim of the invention to achieve the following objects singly or in combination:

to provide a pump, especially for conveying concrete mix or similar mixtures which avoids the above enumerated disadvantages;

to construct the elements of the pump in such a manner that the so-called gap losses are at least minimized over prolonged periods of time, whereby these losses must be maintained at a substantially constant minimum;

to assure that the contact pressure between the radial slides or the rotary piston on the one hand, and the surfaces of the pump housing contacting these slides, and the rotary piston, remains substantially constant over a wide range of operating conditions;

to construct a pump for construction mixtures or the like in such a manner that at least the adjustment of the critical sealing areas, that is, the sealing areas which affect the efficiency of the pump, is effected automatically in response to the wear and tear to which the pump is subjected;

to construct the pump in such a manner that the tendency for sedimentation of the fine components of the conveyed mixture is substantially avoided by eliminating corners in the conveying paths, especially in areas where the material flows at high speeds;

to eliminate any passage of liquid from the conveying channel of the rotary piston into the pump housing proper, whereby to assure a substantially constant efficiency of the pump over prolonged operational periods of time;

to assure a constant contact pressure between the side surfaces or boundaries of the rotary piston and the cylindrical portion of the housing to thereby control the largest possible sealing area inside the pump with regard to its sealing efficiency; and to provide such flow conditions throughout the structure of the pump that sedimentation of the fine components is reduced, that water, slurry, and fine grains are prevented from entering into the space between the stopper body and the rotary piston and also from entering into the rotary piston itself.

SUMMARY OF THE INVENTION

According to the invention, there is provided a pump, especially for conveying of rough mixtures, such as concrete or similar mixtures, wherein a rotary piston is rotatably supported in a housing. The rotary piston is provided with radial slides which are controllable in their variable position in a mechanical manner or through hydraulic means by way of a cam disk which is connected to the stationary pump housing which constitutes a unitary structure with the pump housing. The peripheral sealing of the rotary piston relative to the housing and thus the sealing of the conveying channel is accomplished by means of sealing rings of elastic material fixed in position in the cylindrical housing member, whereby the sealing rings are biased against the cylindrical surfaces or against the side walls or boundaries of the rotary piston. The ends of the radial slides facing toward said cylindrical housing member are constructed for manual or automatic adjustment in accordance or rather in response to their wear and tear. The guides of the radial slides which reach into the rotary piston are provided with automatic sealing means in the form of elastic and/or spring loaded sealing elements. The sealing between the suction inlet and the pressure outlet is accomplished by a stopper body reaching into the conveying channel and sealing the entire cross sectional area of the conveying channel. The stopper body is fixed in the housing with regard to its peripheral position, however, it is adjustable or it adjusts itself in the radial direction.

The above combination of elements has the advantage that liquid is practically prevented from passing out of the conveying channel of the rotary piston into the housing proper. This combination further assures over a long operational period of time a practically constant efficiency of the pump due to the adjustability of the radial slides in the direction of the periphery of the housing. The sealing of the radial slides relative to the rotary piston reduces the possibility that dirt may accumulate in the control guides of the radial slides inside the rotary piston. Such dirt accumulation would prevent the proper operation of the pump.

According to the invention, the stopper body reaches from the pressure side to the suction side of the pump, substantially to a point adjacent to the entrance in the suction or scoop space, whereby a partial back flow of the material from the pressure side to the suction side is prevented and simultaneously the dead space of the pump is reduced to a minimum.

It is also advantageous that according to the invention the sealing between the side surfaces of the rotary piston and the housing is accomplished by elastic hollow bodies guided in the pump housing whereby these hollow bodies contact the diameter of the side walls of the rotary piston and are adjustable by hydraulic or pneumatic means to preselect the contact pressure between the elastic hollow bodies and the side walls of the rotary piston. This feature has the advantage that a constant contact pressure is maintained between the side walls of the rotary piston and the cylindrical portion of the housing and thus the largest possible sealing surface inside the pump becomes controllable in its effectiveness. The surface pressure or load of the sealing bodies on the side walls of the rotary piston is essential for the power consumption of the pump. Therefore, it is advantageous to adjust this loading or contact pressure in accordance with the individual requirements which will especially depend on the type of material being conveyed by the pump.

BRIEF FIGURE DESCRIPTION

In order that the invention may be clearly understood, it will now be described, by way of example, with reference to the accompanying drawings, wherein:

FIG. 1 shows a side view of the pump partially in section and with certain parts broken away to illustrate the pump housing, the rotary piston, and the position of the guide curves or grooves in the covers of the pump housing for controlling the radial slides as well as the stopper body reaching into the conveying channel between the pressure outlet side and the suction inlet side of the pump, the arrows in FIG. 1 indicate the flow of the material through the pump, the rotational direction of the rotary piston, as well as the movement of the radial slides;

FIG. 2 illustrates a section through the pump along section lines 2—2 in FIG. 1, whereby the structure of the housing and the position of an extended radial slide becomes apparent, said radial slide being shown in a position immediately prior to its entry into the suction space of the pump, FIG. 2 further shows the control for guiding of the radial slide by guide means in the housing cover member arranged in corresponding positions in both sides of the radial slide whereby the latter is provided with a spring bias compensation for any play;

FIG. 3 shows a partial section along section line 3—3 in FIG. 1, whereby the section extends through the stopper body reaching into the conveying channel;

FIG. 4 shows a section along section line 4—4 in FIG. 1 through the housing in the direction of the pressure and suction connecting ports, both ports lead tangentially into the conveying space of the pump and extend in parallel to each other, whereby the square cross-section merges into a circular cross-section for the connection of the suction and pressure pipes; and FIGS. 5 and 6 show two different ways of adjusting the radial position of the stopper body.

DETAILED DESCRIPTION OF PREFERRED EXAMPLE EMBODIMENTS

Figure 1:
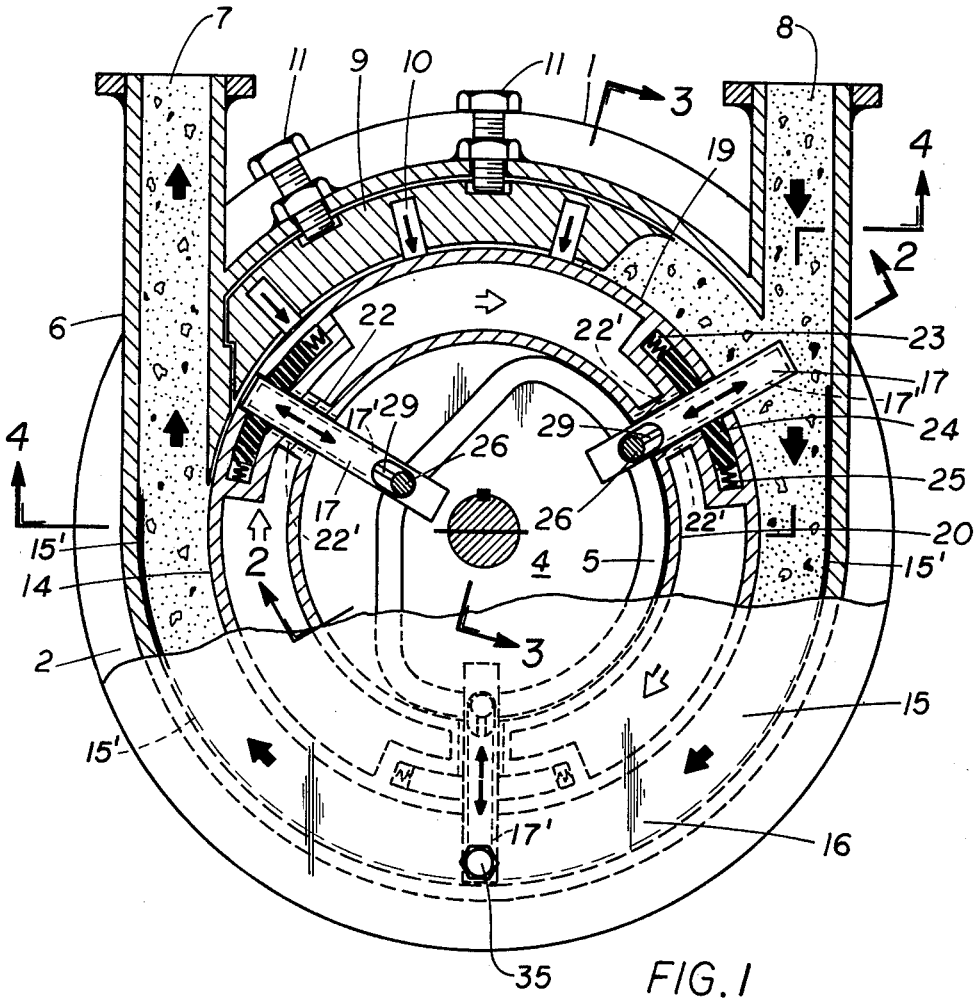

The housing 1 comprises a cylindrical main housing member 6 and two housing cover members 2 and 3 which simultaneously carry the control or guide means 4 provided with guide grooves 5. The inlet or suction port 8 as well as the outlet or pressure port 7 lead tangentially into the housing member 6. Simultaneously, the inlet and outlet ports extend in parallel to each other.

A stopper body 9 is provided with sealing sleeves 10 and is adjustable in the radial direction inside the housing member 6 of the housing 1. The stopper body 9 reaches into the conveying channel 15 of the rotary piston 14. The adjustment or readjustment of the sealing sleeves 10 is accomplished in this example embodiment by means of pressure screws 11 extending through the cylindrical housing member 6 of the housing 1. On the pressure side of the pump the stopper body 9 guides the flow of material toward the outlet port 7, whereby the stopper body 9 reaches, as viewed in the clockwise direction, to a point just ahead of the suction area of the pump, that is, the suction space of the pump. The stopper body 9 is shaped as a ring segment body in such a manner, that the radial slides 17 may fully enter into the flow of material when the radial slides 17 are in their fully extended position.

The housing member 6 of the housing 1 is further provided with grooves 12 and 13 extending over the entire circumference for receiving sealing elements or ring 13' which contact the side walls 16 of the rotary piston 14 in a sealing manner. In the illustrated example, the sealing elements or rings 13 are made of an elastic material. However, it is also possible to replace these sealing rings 13' by elastic hollow bodies, the inner space of which is supplied with a hydraulic or pneumatic pressure medium so that the contact pressure is adjustable in precise steps and in response to the wear and tear even over a prolonged period of time.

The guide grooves 5 in the guide channels 4 make it possible to move the radial slides 17 into the extended position to a point just prior to entry into the pressure space of the pump. In this position, the radial slides 17 seal the conveying channels 15 against back flow. The point at which this back flow sealing takes place may be defined as the contact point of the tangent of the inside of the inlet 8 with the inside of the cylindrical housing member 6. The radial slides 17 convey the material through the conveying channel 15 until the respective radial slides 17 are withdrawn into the rotary piston 14 and thus out of the conveying channel 15. The withdrawal begins at a point where a radial slide 17 reaches immediately adjacent to the stopper body 9, which is a point just ahead of the outlet port 7.

The rotary piston 14 comprises a hollow structure, the side walls of which are formed by two disks 18 adjacent to the side boundaries 16. The bottom of the conveying channel 15 is formed by the outer ring 19 which holds the inner ring 20 as well as the hub ring 21 in a concentric manner.

The dimension of the inner ring 20 is determined by the maximum stroke of the radial slide 17 as far as these radial slides comprise a projection which in this position is directed inwardly and which corresponds to the guide means 4 and the grooves 5 of the guide means 4. The rings 19 and 20 are interconnected by means of three lands each extending over an angle of 120° and which lands define guide channels 22 which are open inwardly and outwardly for the guiding of the radial slides. These guide channels 22 are widened to provide a sealing space 23 adjacent to the outlet port. Each of these sealing spaces 23 holds two elastic sealing means 24. The sealing effect of each of these sealing means 24 is increased by a pressure spring 25.

The surfaces of the radial slides 17 may be provided with replaceable sliding improving surface coatings or inserts, indicated in FIG. 1 with dashed lines 17'. Similarly, the surfaces of the housing portions such as the conveying channel 15 and the guide channels 22 in contact with the radial slides 17 may be provided with wear resistant surfaces 15', 22' or the like to improve their durability.

The radial slides 17 are guided in the grooves 5 of the guide means 4 by bolts 26 reaching into these grooves 5. The bolt 26 is held in a hub 28 forming part of the slide plate 27 proper. The hub 28 comprises a hollow cross-section as viewed in the radial direction to form a free space which receives a leaf spring 29. The bolt 26 extends through a respective semi-cylindrical aperture and is biased by the leaf spring 29 which holds the bolt 26 in position.

The pump operates as follows. The radial slides 17 are inserted under a predetermined maximum tension of the springs 29 when the rotary piston 14 is assembled in the housing 1. In response to wear and tear of the radial slides the leaf springs 29 are relieved whereby they force the radial slides 17 into the intended sealing position over prolonged periods of time. The disks 18 are provided with recesses 36 which take into account the stroke of the bolt 26.

The rotary piston 14 is driven by the hydraulic motor 30 which is secured to the housing cover 2. The drive shaft 31 of the motor 30 is connected to the rotary piston 14 by means of the hub ring 21 which is wedged to the drive shaft 31. The housing cover 3 comprises a recess 33 which receives securing means 32 for the shaft.

The rotary piston 14 and the disks 18 thereof are provided with sealing rings 34 of elastic material and having a groove shape. These rings 34 or rather the grooves formed thereby serve for the purpose of removing any leakage liquid which may pass between the cylindrical portion 6 of the housing 1 and the side walls 16 of the rotary piston 14. Such slight leakage might occur in spite of the sealing means 13. These rings 34 contact the inner surfaces of the housing covers 2 and 3 and provide an additional sealing of the space containing the guide means 4, 5. The liquid may be removed from the pump housing at the lowest point thereof, for example, out of the covers 2 and 3 by means of a respective outlet plug 35.

As described above, the stopper or closure body 9 is sealed with respect to the bottom of the conveying channel 15 by sealing elements 10, which also reach around the side walls of the stopper body 9. The sealing elements may, for example, be constructed as wiper elements which simultaneously function as the necessary seal.

Incidentally, the above mentioned surface coatings or inserts 17' of the slides 17 improve the wear and tear resistance of these radial slides 17. These wear and tear resistant coatings or inserts 17' will be located on the slides 17 so as to face the respective housing portions or inner walls as well as of the conveying channel 15. These inserts 17' may be of high alloy steel which improves the sliding capability of the slides 17.

Where it is necessary to lift the concrete mix or similar heavy mixtures over unusually high elevational differences, the invention suggests that the radial slides 17 are held in grooves which are provided with elastical sealing lips and which are so positioned and dimensioned that the sealing lips contact the slides over their fully extended sides. This feature has the advantage that overloading of the slides 17 by the pressure in the pump is avoided and that the size of the slides 17, especially their thickness may be kept in reasonable bounds. Further, for the adjustment of the stopper body 9 which reaches into the conveying channel 15 in the radial direction, there are provided elastic hollow bodies which are arranged between the stopper body 9 and the cylindrical housing wall. These hollow bodies are adapted for receiving liquid or a gas under pressure, whereby the respective sealing is easily adjusted. Similarly, such elastic, hollow bodies may be provided between the rotary piston 14 and the inner walls of the housing chamber in contact with the rotary piston 14.

A biasing spring means could also be inserted between the inner housing wall and the stopper body 9 as best seen in FIG. 1. Such a spring would be effective in addition to, or instead of the adjustment screws 11 for forcing the stopper body 9 radially inwardly.

As illustrated in FIG. 1, it will be noted that the slides 17 are controlled in such a manner that they are already in an extended position before they enter into the area of the inlet port as best seen in the upper right hand part of FIG. 1. This feature has the advantage that the suction flow in the suction or inlet space is not cut through, thereby avoiding any tendency to demix.

The above described features for the sealing of the stopper body 9 relative to the rotary piston 14 and the sealing of the rotary piston 14 relative to the housing, apply equally to the peripheral sealing of the radial slides 17 relative to the pump housing. The latter type of sealing at the periphery of the slides 17 should also be adjustable. Thus, the radial slides 17 are adjustable by adjustment screws which permit the varying of the end position or fully extended position of the slides 17. Here again, the adjustment could be accomplished also by springs and/or by hydraulic or pneumatic means.

Figure 2:
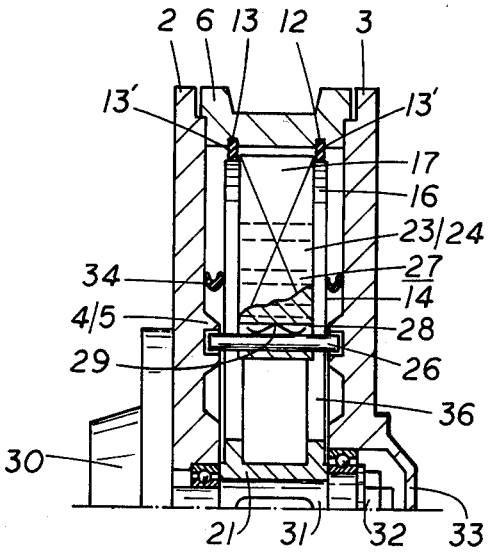
Figure 3:
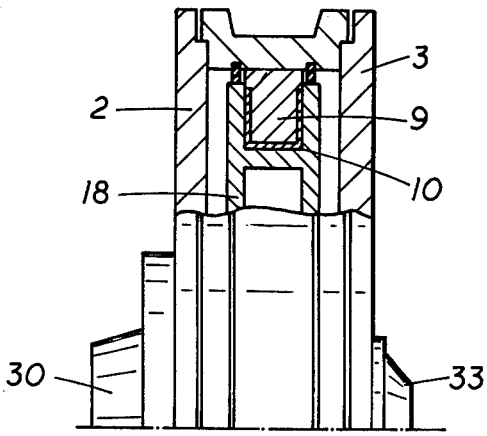
Figure 4:
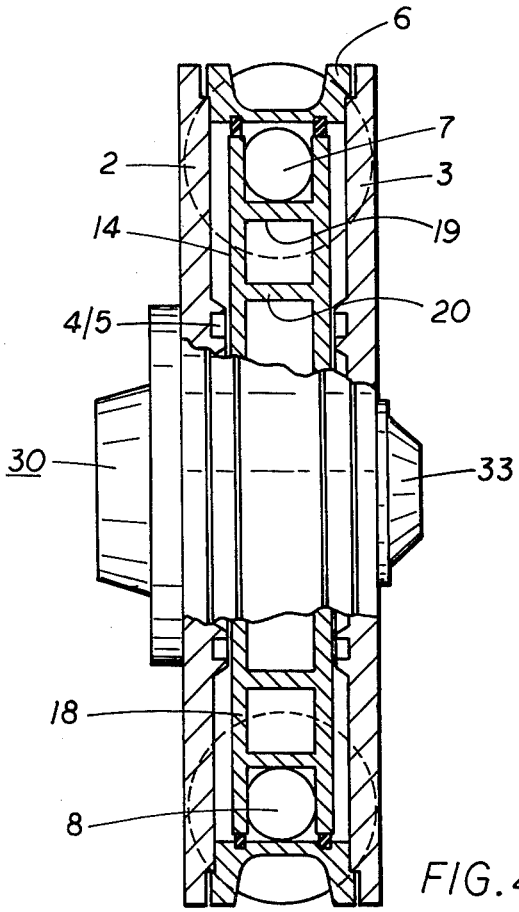
Figure 5:
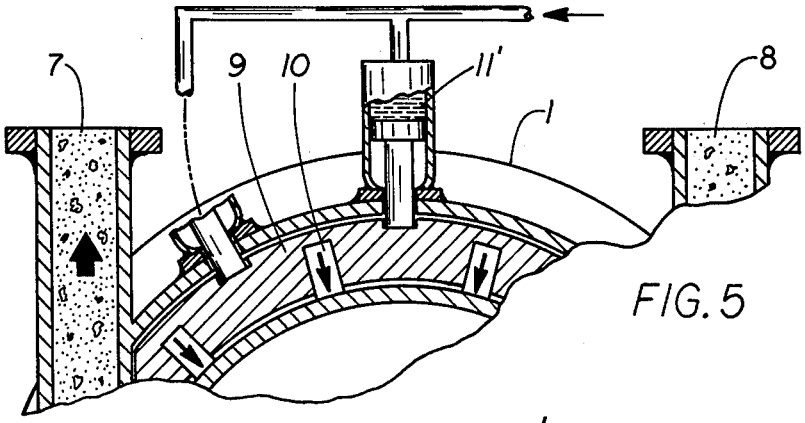
Figure 6:
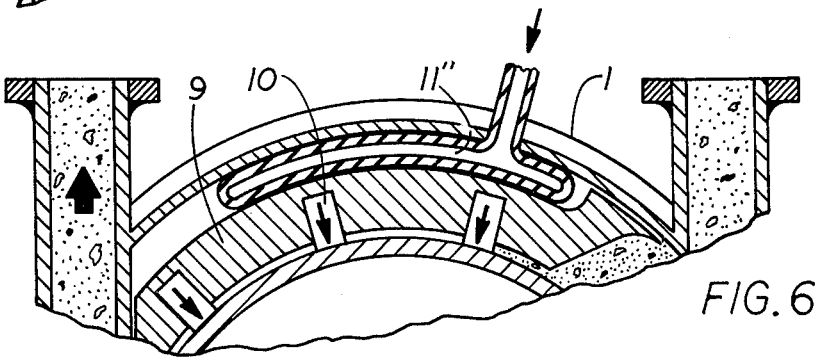

Incidentally, FIGS. 5 and 6 show hydraulic or pneumatic means 11', 11'' which may be used, instead of screws 11, to adjust the radial position of the stopper body 9. The pressure bag 11'' of FIG. 6 is inserted between the housing 1 and the body 9. The pressure bag 11'' could be replaced by springs similar as those shown at 29 in FIG. 2.

The combination of the features according to the invention has the advantage that not only a flow facilitating pump structure is accomplished, but that also any tendency of sedimentation of the fine particles in the mixture is reduced and that the entry of water or slurry as well as of the fine particles between the stopper body 9 and the rotary piston 14, as well as into the inside of the rotary piston 14 are avoided.

The groove shaped sealing strips 34 arranged between the side walls or disks 16, 18 of the rotary piston 14 and the respective housing surfaces have the advantage that the space containing the guide means 4, 5 is kept free of leakage water because the groove shaped sealing rings 34 envelope the space containing the guide means 4, 5. Yet another advantage of this feature is seen in that the space between the inner housing walls and the rotary piston is also kept substantially free of leakage water because the groove shaped sealing rings 34 guide any leakage water to a point in the pump housing which has the lowest elevation from which the leakage water may easily be drained.

Although the invention has been described with reference to specific example embodiments, it is to be understood, that it is intended to cover all modifications and equivalents within the scope of the appended claims.

What is claimed is:

1. In a pump having housing means with inlet port means and outlet port means as well as rotary piston means rotatably mounted in said housing means, said rotary piston means and said housing means defining a conveying channel between said inlet and outlet port means, said conveying channel having a suction end adjacent said inlet port means and a pressure end adjacent said outlet port means, radially displaceable slide means mounted on said rotary piston means for radial movement into and out of said conveying channel, guide means in said rotary piston means for guiding the radial movement of said slide means, and cam means in said housing means for radially moving said slide means in response to piston rotation, the improvement comprising first sealing means (12, 13) operatively arranged between said housing means and said rotary piston means substantially along the circumference of said rotary piston means adjacent to each side thereof, second sealing means (24, 25) operatively arranged to provide a seal between said radially displaceable slide means and said guide means, third sealing means (29) arranged to urge said slide means with the outer ends thereof radially against said housing means, fourth sealing means (9, 10) operatively arranged between said outlet port means and said inlet port means to block return flow from said outlet port means to said inlet port means and fifth sealing means (34) in the form of a sealing ring having a radially outwardly facing V-groove, one such sealing ring being inserted on each side of the rotary piston means between the latter and the respective housing means, said V-groove sealing rings extending laterally around said guide means and said cam means to further seal the guide means and the cam means against leakage penetration.

2. The pump according to claim 1, wherein said housing has a cylindrical member and two cover members, wherein said first sealing means comprise two grooves in the inner wall of said cylindrical housing member, and sealing ring means (12, 13) of elastic material held in said grooves, said ring means extending into elastic contact with said rotor means (16).

3. The pump according to claim 1, wherein said second sealing means comprise spring means which urge said guide means against said slide means.

4. The pump according to claim 1, wherein said third sealing means comprise spring means operatively arranged to urge the slide means radially outwardly.

5. The pump of claim 1, further comprising wear resistant surfaces on the slide means and on the portions of the housing means in contact with the slide means as well as on the portions of the conveying channel in contact with the slide means.

6. The pump of claim 1, wherein said second sealing means for guiding said slide means comprise grooves in said rotary piston means and elastic sealing means in said grooves for guiding said slide means as the slide means move in the radial direction.

7. The pump of claim 1, wherein said fourth sealing means comprise a ring segment body arranged in said conveying channel, and a hollow elastic body extending between said ring segment body and said housing means, said hollow elastic body providing a fluid seal, and pressure supply means operatively connected to said hollow elastic body.

8. The pump of claim 1, wherein said fourth sealing means comprise a ring segment body (9) arranged in said conveying channel, and pressure means between said ring segment body and said housing for biasing said ring segment body in the radial direction.

9. The pump of claim 1, wherein said cam means are shaped to extend said slide means radially outwardly into said conveying channel upstream of said inlet port means but downstream of said outlet port means.

10. The pump of claim 1, wherein said fourth sealing means comprise a ring segment body arranged in said conveying channel and screw means in said housing for radially adjusting the position of said ring segment body.

11. The pump of claim 1, wherein said inlet port means and said outlet port means extend tangentially to said conveying channel and in parallel to each other.

12. The pump according to claim 1, wherein said fourth sealing means comprise a ring segment body (9) arranged in said conveying channel (15), elastically yielding sealing means arranged between said ring segment body (9) and said rotor means (14), and means for adjusting the position of said ring segment body in the radial direction.

13. The pump of claim 12, wherein said housing means include axially spaced cover members (2, 3) with inwardly facing walls, said ring segment body (9) extending radially into said conveying channel (15) between said inwardly facing walls, and wherein said elastically yielding sealing means (10) on said ring segment body (9) engage said rotor means (18).

14. In a pump comprising a housing, a rotary piston rotatably mounted in said housing, whereby said housing and piston define an annular conveying channel at the radially outer periphery of said piston, and inlet and outlet ports extend tangentially to said channel parallel to one another from the same direction, whereby a back flow path between said outlet and inlet is formed by one course of said conveying channel, and wherein said pump further comprises radially displaceable slides mounted on said piston for movement into and out of said channel, means on said rotary piston for guiding said slides for radial movement, and cam means on said housing for radially moving said slides; the improvement wherein said rotary piston comprises a pair of axially spaced apart side disks, an annular channel bottom extending between said disks, and a plurality of radially extending guide slots, said pump further comprising sliding seal means between the outer periphery of said side disks and said housing, whereby said conveying channel is defined by said side disks, channel bottom, sliding seal means and housing; said pump further comprising a stopper in said back flow path, means for mounting said stopper at a fixed peripheral position with respect to said housing, means for radially adjusting said stopper, and sealing means for slidably sealing the space between said stopper and said disks in the channel bottom, whereby said back flow path is fully blocked; and further comprising means for resiliently urging said slides radially outwardly, and means in said guide slots for sealingly guiding said slides and sealing means in the form of a sealing ring having a radially outwardly facing V-groove, one such sealing ring being inserted on each side of the rotary piston between the latter and the respective housing, said V-groove sealing rings extending laterally around said guide means and said cam means to further seal the guide means and the cam means against leakage penetration.

15. The pump of claim 14, wherein said cam means comprise a cam slot in said housing adjacent a side of said piston, slides having axially extending holes therein, said holes being elongated in the radial direction, and further comprising cam follower shafts extending into said holes in said slides and into said cam slot for radially moving said slides, said means for urging said slides radially outwardly comprising spring means in said holes on the radially outwardly side of said shafts, whereby said slides are urged resiliently radially outwardly, with respect to said shafts.

16. The pump of claim 14, wherein said means in said slots for sealingly guiding said slides comprise sealing means mounting said piston as the radially outer periphery thereof, and resilient means for resiliently urging said last mentioned sealing means circumferentially to engagement with each side of said each slide at the sides of said guide slots.

* * * * *